US006695508B2

(12) United States Patent
Gueret

(10) Patent No.: US 6,695,508 B2
(45) Date of Patent: Feb. 24, 2004

(54) CASE AND METHOD FOR PACKAGING A SUBSTANCE

(75) Inventor: Jean-Louis H. Gueret, Paris (FR)

(73) Assignee: L'Oréal, Paris (FR)

( * ) Notice: Subject to any disclaimer, the term of this patent is extended or adjusted under 35 U.S.C. 154(b) by 0 days.

(21) Appl. No.: 09/969,762

(22) Filed: Oct. 4, 2001

(65) Prior Publication Data

US 2002/0056660 A1 May 16, 2002

(30) Foreign Application Priority Data

Oct. 4, 2000 (FR) ..... 00 12665

(51) Int. Cl.[7] ..... A45D 33/02

(52) U.S. Cl. ..... 401/9; 401/127; 401/130; 401/192; 401/261

(58) Field of Search ..... 401/9, 130, 126, 401/127, 192, 261, 262, 267, 118

(56) References Cited

U.S. PATENT DOCUMENTS

| | | | | |
|---|---|---|---|---|
| 2,365,921 A | * | 12/1944 | Vaughn | 401/192 |
| 2,623,228 A | * | 12/1952 | Sherry | 401/130 |
| 3,221,359 A | * | 12/1965 | Moroni et al. | 401/130 |
| 3,760,985 A | | 9/1973 | Bryan | |
| 3,871,390 A | * | 3/1975 | Spatz | 401/130 X |

FOREIGN PATENT DOCUMENTS

| | | | |
|---|---|---|---|
| EP | 44781 | * 1/1982 | 401/192 X |
| FR | 2 524 865 | 10/1983 | |
| GB | 2 062 469 | 5/1981 | |

OTHER PUBLICATIONS

Patent Abstracts of Japan, vol. 2000, No. 13, Oct. 3, 2000, JP 2000 270995.

English language Derwent Abstract of FR 2 524 865, Oct. 14, 1983.

* cited by examiner

*Primary Examiner*—Gregory Huson
*Assistant Examiner*—Kathleen J. Prunner
(74) *Attorney, Agent, or Firm*—Finnegan Henderson Farabow Garrett & Dunner, L.L.P.

(57) ABSTRACT

A case for packaging a substance, such as a semiliquid substance, for example a makeup product and/or a care product. The case comprises a body suitable for receiving the substance and a lid suitable for pressing against the substance in the case body to enclose the substance in a leak-proof manner. The lid and the body have internal profiles configured such that, at least prior to first use, and after the substance has flowed under the effect of its own weight while the lid is not present on the body, installing the lid on the case body reduces the maximum thickness of the substance.

29 Claims, 7 Drawing Sheets

CASE AND METHOD FOR PACKAGING A SUBSTANCE

The present invention relates to a case for packaging a substance, such as, for example, a makeup or care product, the case being of the type comprising a body having a cavity suitable for receiving the substance and a lid suitable to enclose the substance in a leak-proof manner.

1. Field of the Invention

The volume of the cavity defined inside the case may be generally greater than the volume occupied by the substance, with the volume occupied by the substance decreasing as it is used up.

2. Description of the Related Art

Cases used for packaging makeup, such as blushers, often are carried about, e.g. in a handbag, while being moved into positions in which the contents may shift within the cavity.

Some substances, such as creams, possess surface tension or texture such that the substance does not shift significantly in the packaging case even when the substance occupies only part of the cavity inside the case, and this could apply regardless of the position in which the case is stored.

Other substances, such as fluids or powders, have characteristics such that they return quickly into position when the case is oriented to allow a user to access the product in the case.

In both of the two above-mentioned situations, when the case is open, the substance could be properly in place in the cavity defined by the case body and ready to enable the user to apply it with a finger and/or an applicator, for example.

For some substances, when a case has been carried about in a handbag, for example, the substance moves within the cavity of the case body and does not return instantly into position in the cavity. Examples of such substances include those of semiliquid consistency, for example, lotions, pastes, and/or gels of a consistency such that they flow under the effect of their own weight in ordinary temperature ranges, and also substances having viscoelastic formulations (i.e., formulations that are slow to return to an equilibrium state after being moved) in addition to substances having formulations of the associative polymer and/or memory polymer type.

When a substance shifts and does not readily return, the substance could be difficult to extract and it may be difficult to place an appropriate quantity on a finger and/or an applicator to obtain uniform application, for example, when the substance is a makeup product and/or a care product.

SUMMARY

One optional aspect of the present invention involves a case for packaging a substance, such as, for example, a makeup product and/or a care product. Examples of such substances include substances having semiliquid consistency, substances having viscoelastic formulations, and substances of the memory polymer and/or associative polymer type. Although certain embodiments are described in association with particular types of substances, it should be understood that the invention, in its broadest aspects, is not limited to being used with any particular substance.

Optionally, the present invention could avoid one or more drawbacks of known cases. For example, it could be possible to ensure that the substance within the case keeps an attractive appearance, such as when the case is open, thus ensuring that the substance can be extracted by means of a finger and/or an applicator.

In an optional aspect of the invention, the case may comprise a body having a cavity suitable for receiving the substance and a lid suitable to enclose the substance in a leak-proof manner. The lid and the body of the case may have internal profiles configured such that at least prior to a first use of the substance, and after the substance has flowed under the effect of its own weight while the lid is not present on the case body, installing the lid on the case body presses the lid against the product to reduce the maximum thickness of the substance. As used herein, the term "profile" may refer to the shape of a three dimensional surface.

In an exemplary embodiment, putting the lid into place on the case body may reshape the substance, thereby establishing a satisfactory appearance and shape.

In one optional aspect, the inside of the lid has an inner surface having a shape corresponding substantially to the shape of the cavity and arranged so that when the lid is put into place on the case body, it defines a gap in the cavity having a height smaller than the depth of the cavity, so that when the case is in a closed position, the substance substantially fills the gap and contacts the inner surface of the lid in addition to a portion of the case body defining the cavity.

For example, when the case is in the closed position, the substance housed therein may occupy substantially all of the available volume, and may be substantially prevented from changing shape while the case is being carried, for example, in a handbag.

With certain exemplary embodiment, even after an amount of substance has been extracted, given the volume defined between the inner surfaces inside the case, the substance may be somewhat maintained in a shape such that when the case is open, the substance may be found, depending on circumstances, either on the portion of the case body defining the cavity or on the inner surface of the lid, and in a disposition that makes it possible to remove the substance under acceptable conditions. For example, the substance may remain substantially homogeneous and have a controlled thickness, e.g., a substantially constant thickness.

For at least some substances, a depression formed in the substance, after extraction of some substance, may be filled by the substance flowing under the effect of its own weight.

In another optional aspect, the portion of the case body defining the cavity and inner surface of the lid may be substantially hemispherical in shape. The inner surface of the lid may have a diameter less than a diameter of the cavity and/or the portion of the case body defining the cavity. As used herein, the term "diameter" is not limited to describing a dimension of an object having a circular or substantially circular outer cross-sectional boundary. In the case of non-circular configurations, the term "diameter" refers to the diameter of a circle inscribing the cross-sectional boundary.

The portion of the lid defining its inner surface may be an integral, one piece construction with the remainder of the lid. In an optional variant, the inner surface may be defined by a dome fitted to the inside of the remainder of the lid. For example, a portion of the lid having the internal profile may be a separate element fitted to the remainder of the lid. The dome may optionally be made of a material that is more flexible than the lid.

Additionally, the case body and/or the lid may be made, at least in part, out of a transparent or translucent material enabling the substance and/or an outline of the substance to be seen from the exterior of the device and, where applicable, possibly revealing how much of the substance has been consumed. If a colored substance is used in conjunction with such a transparent or translucent case, the substance and/or its outline may be viewed through the case, and optionally in association with a magnifying effect, this may confer a desirable appearance to the substance-containing case.

The lid and the case body may be fastened together by screw fastening, or in an optional variant, the lid may be mounted on the case body by means of a hinge and can be secured thereto, for example, by snap-fastening.

Sealing means may be provided between the case body and the lid. For example, the sealing means could be in the form of an O-ring, a sealing lip, or of some other form. Sealing may also be provided by facing conical bearing surfaces on the case body and on the lid. It should be understood that certain embodiments of the case could be arranged to provide leak-proof enclosure of the product in the case without usage of any sealing means.

In an optional aspect, the inner surface of the lid may have one or more surface properties and/or one or more configurations (e.g., facets) that are different from those of the portion of the case body defining the cavity, so that the substance may be retained on the inner surface of the lid. For example, the lid may be used as an applicator for the substance, with a somewhat controlled thickness of the substance being held on the inner surface of the lid.

In an optional aspect, the portion of the case body defining the cavity may have a surface state different from that of the lid, e.g., for the purpose causing the substance to be retained in the case body.

In an optional aspect, a method for packaging a substance comprises providing a case, flowing into the cavity at least a predetermined amount of a substance, and placing the lid on the case body, thereby pressing the lid against the substance to cause the substance to substantially fill a gap defined between the lid and the case body.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

According to another optional aspect, a method for packaging a substance comprises providing a container comprising a lid and a cavity, at least a portion of the lid being configured to protrude at least partially into the cavity, flowing into the cavity at least a predetermined amount of a substance, and placing the lid in a closed position on the cavity to thereby put the lid in contact with the substance and cause the substance to substantially fill a gap defined between the lid and a portion of the container defining the cavity.

One of the inner surface of the lid and the portion of the case body defining the cavity may be of a shape that is not a body of revolution, thereby preventing the substance from turning relative to the case body when the case is opened. As used herein, the term "body of revolution" is used to define a shape formed by rotation of a planar surface about an axis to create a three-dimensional body. Forming a shape on either of the inner surface of the case body or the inner surface of the lid, such as, for example, a diamond-shape, would create an inner surface that could not be created by a body of revolution.

Aside from structural and procedural arrangements set forth above, the invention could include a number of other arrangements, such as those explained hereinafter. It is to be understood that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings.

DETAILED DESCRIPTION

Figure 1:
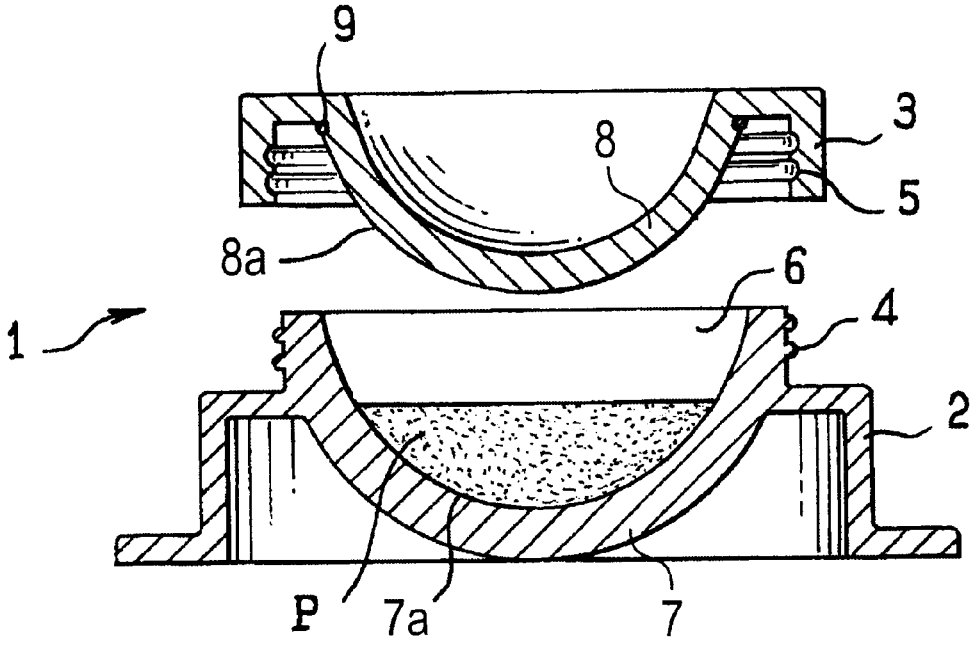
FIGS. 1 to 6 are cross section views showing an exemplary embodiment of a packaging case during different stages of filling and use.

Reference will now be made in detail to exemplary embodiments of the invention, examples of which are shown in the drawings. Wherever possible, the same reference numbers are used in the drawings and the description to refer to the same like parts.

With reference initially to FIGS. 1 to 6, an exemplary embodiment of a packaging case 1 comprises a case body 2 and a lid 3. In the illustrated embodiment, the case body 2 and the lid 3 have respective mutually engageable threads 4 and 5 to enable the lid 3 to be assembled on the case body 2 by screw fastening. The inside of the case body 2 has a cavity 6 of substantially hemispherical shape defined by a wall 7. The lid 3 includes an inner surface 8*a* forming a substantially hemispherical dome whose apex is directed towards the case body 2 when the lid 3 is put into place thereon. For example, the inner surface 8*a* of the lid 3 in contact with the substance P when the lid 3 is installed on the case body 2 may be dome-shaped.

As can be seen in FIG. 1, the diameter of the inner surface 8*a* of the lid 3 is smaller than the diameter of the portion of the wall 7 defining the cavity 6 in the case body 2. Thus, when the lid 3 is placed onto the case body 2, a gap defined by the inner surface 8*a* of the lid 3 and the wall surface 7*a* of the case body 2 may have a non-uniform thickness. Means for sealing the inside volume of the case are provided and, in the example shown, they are in the form of an O-ring 9. These sealing means can be constituted by gaskets of some other type and/or they can be formed by corresponding conical portions formed on the ends of the inner surface 8*a* of the lid 3 and the portion of the wall 7 of the case body that defines the cavity 6.

Figure 1A:
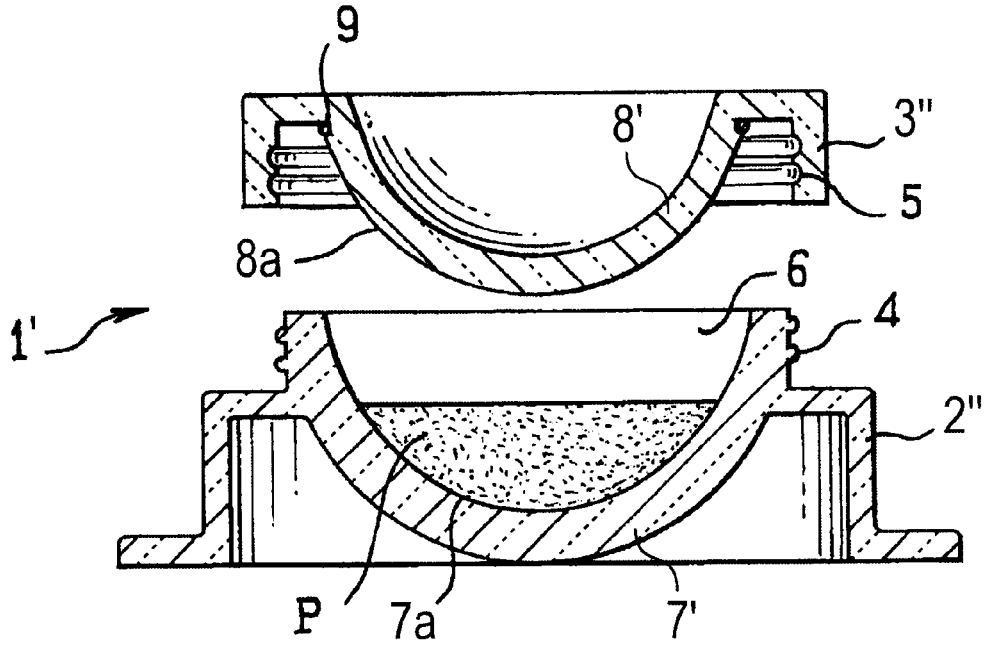
FIG. 1A is a cross-sectional view of an exemplary embodiment of a packaging case having a case body and a lid being made of transparent and/or translucent material.

The case body 2 and the lid 3 can be made of any suitable material, such as, for example, a rigid plastic material, with the case body 2" and the lid 3" optionally being made entirely or partially out of a transparent or translucent material, as shown in, for example, FIG. 1A. For example, the hemispherical walls 7' and 8' could be made out of transparent or translucent material. In an exemplary embodiment, at least a portion of the inner surface 8*a* of the lid 3 may be defined by a rigid material.

FIG. 1 shows the packaging case 1 while it is still open and after it has had a predetermined quantity of a substance P deposited therein. This substance may be makeup having a viscoelastic formulation that is very slow in settling after a change in position. It can be assumed that the case has been open for long enough to ensure that the substance P contained therein has flowed under the effect of its own weight so that its surface has become substantially horizontal.

Figure 2:
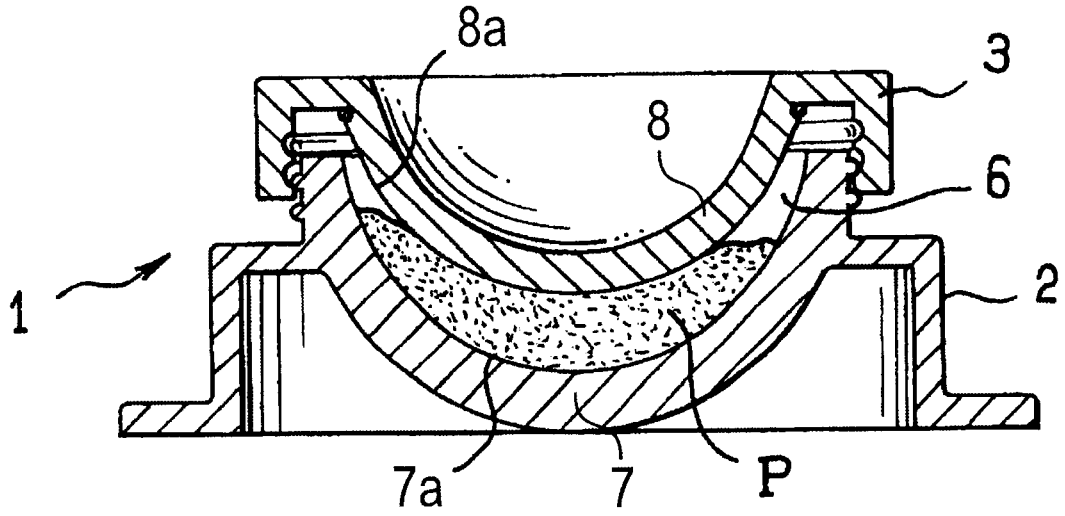
Figure 3:
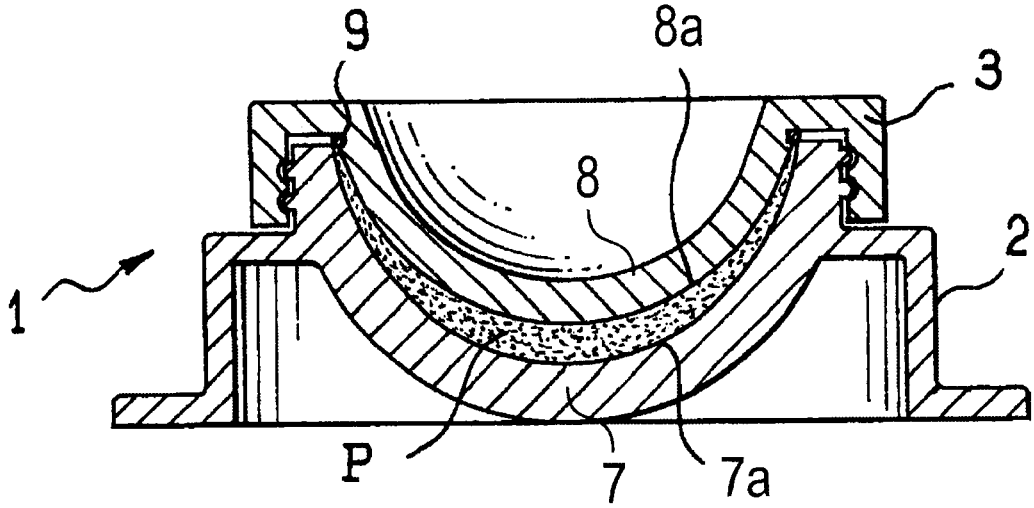

The lid 3 may be configured to change the shape of the upper surface of the substance P when the lid 3 is placed on the case body 2 in a closed position. For example, as can be seen in FIGS. 2 and 3, when the lid 3 is put into place and screwed onto the case body 2, the substance P is pressed between the facing surfaces 7*a* and 8*a*, thus causing it to flow and occupy substantially all of the volume between the surfaces in the closed position, as shown in FIG. 3. The height of this volume may be significantly smaller than the height of the cavity 6 in the case body 2.

Figure 4:
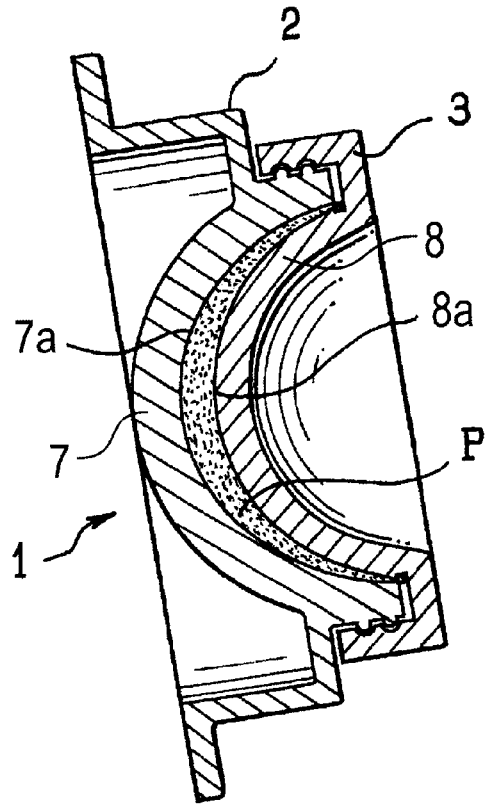
Figure 5:
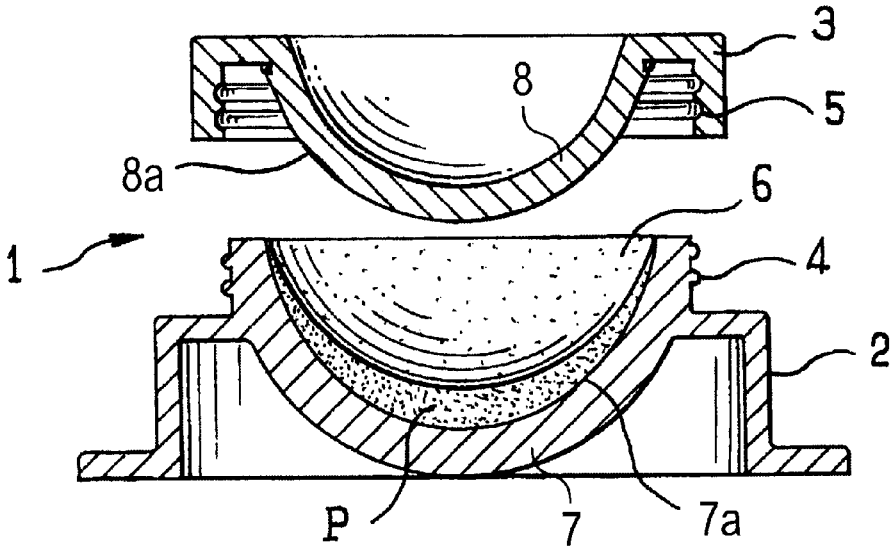

As can be seen in FIG. 4, when the exemplary embodiment of the case assumes arbitrary positions other than the horizontal position shown in FIG. 3, e.g., while being carried in a handbag, the substance P does not move within the volume defined between the surfaces 7*a* and 8*a*. After the lid has been removed, in the position shown in FIG. 5, the substance P in the case body presents a shape that has been imparted thereto when the case was closed, e.g., a bowl shape, that can be considered as covering substantially the entire surface of the portion of the wall 7 defining the cavity in a balanced manner.

Because of its small thickness, the substance P may be well-placed to enable substance to be extracted by a user by means of a finger and/or with the help of an applicator. In addition, due to its rheology, the substance P could tend to return to its equilibrium shape only very slowly, and the bowl shape that can be seen in FIG. 5 may remain for some time.

When the lid is put back into place, the substance may again be compressed by an amount corresponding to its deformation memory so as to ensure that when the case is opened again, the substance may be again in substantially the same bowl shape. It can thus be said that the substance is put into equilibrium within the case body 2 on first closure, and is put back into equilibrium during subsequent closures.

Figure 6:
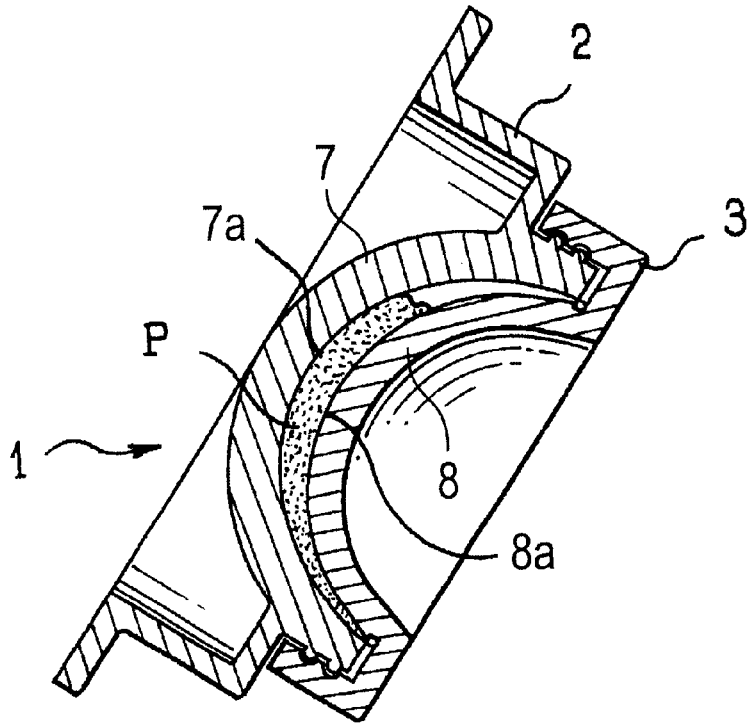
Figure 7:
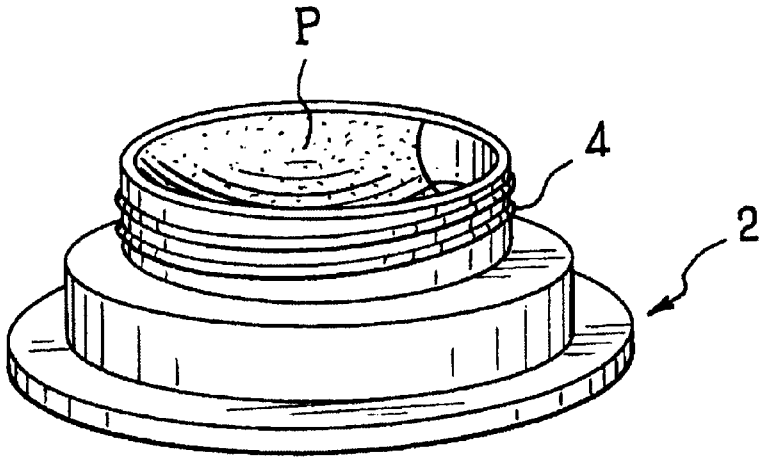
FIG. 7 is a perspective view showing the body of the packaging case of FIGS. 1 to 6 in position for extracting substance therefrom.

FIGS. 6 and 7 show the case 1 and the case body 2 after substance has been extracted. Optionally, the extent to which the substance has been used could be visible from the exterior of the case 1 if the case body 2 and/or the lid 3 are made completely or in part out of transparent or translucent material, as mentioned above.

Figure 8:
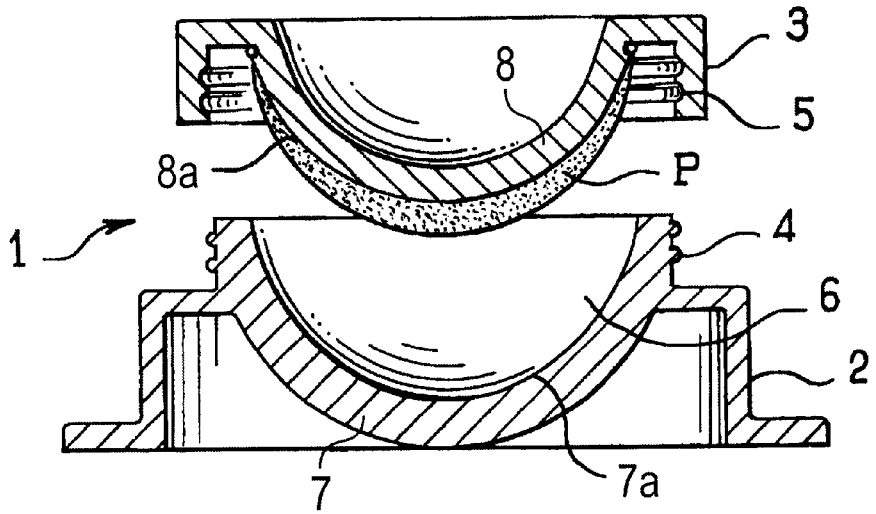
FIG. 8 is a view analogous to FIG. 5 showing an alternate embodiment.
Figure 8A:
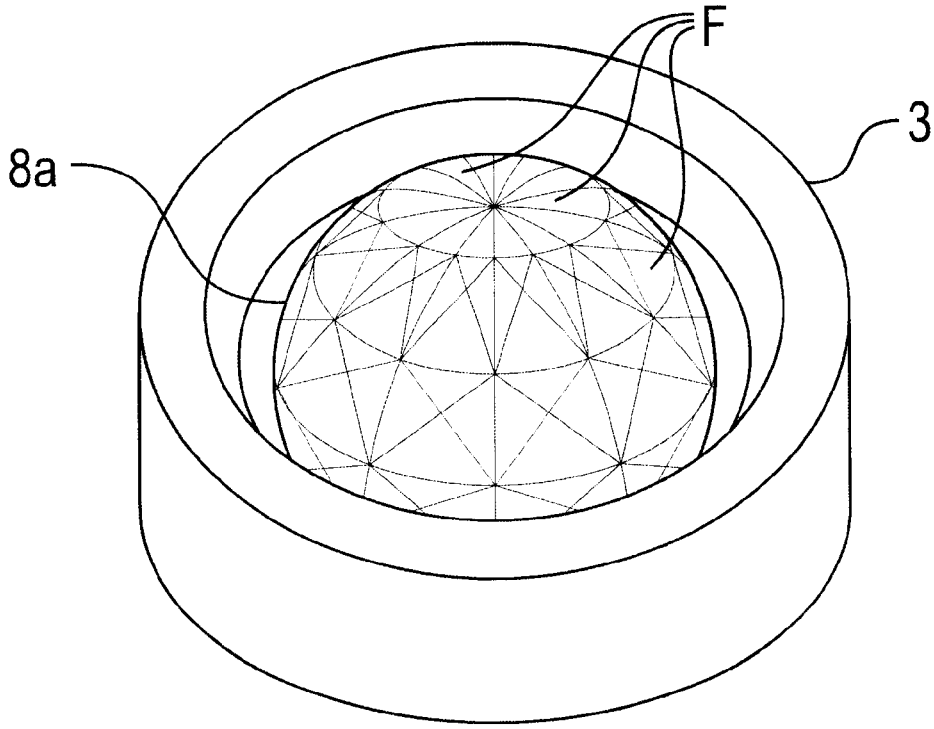
FIG. 8A is a perspective view showing an exemplary embodiment of a lid having an internal profile that is not a body of revolution.

FIG. 8 shows an alternate embodiment in which the inner surface 8*a* of the lid 3 has been treated or arranged in such a manner as to ensure that the substance P remains against the inner lid surface 8*a* rather than against the portion of the inner wall surface 7*a* defining the cavity 6 in the case body 2. As seen in FIG. 8A, this may be achieved, for example, by means of facets F formed on the inner surface 8*a* of the lid 3, analogous to cutting a diamond, with the portion of the wall 7 defining the cavity 6 then being given a smooth polished appearance so as to limit the amount of substance adhering thereto. This configuration of the inner surface 8*a* of the lid 3 would not be a body of revolution.

Figure 8B:
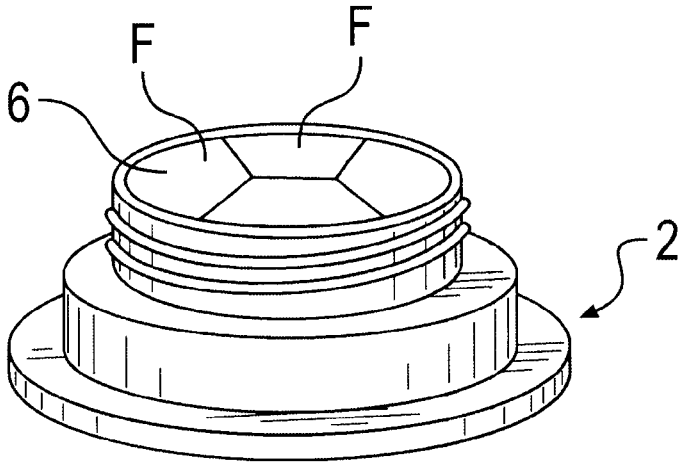
FIG. 8B is a perspective view showing an exemplary embodiment of a case body having an internal profile that is not a body of revolution.

FIG. 8B shows an alternative configuration whereby the cavity 6 has facets F to aid in ensuring that the substance P is maintained in the case body. In the configuration of FIG. 8B, this could further be aided by giving a smooth polished appearance to the inner surface 8*a*of the lid 3 to limit the amount of substance adhering to the lid.

Choosing certain materials for making the case body 2 and the lid 3 may also make it possible for the substance to be retained on the inner surface 8*a* of the lid 3. It will be understood that in the exemplary embodiments of FIGS. 8 and 8A, the lid may be used as an applicator for the substance.

Figure 9:
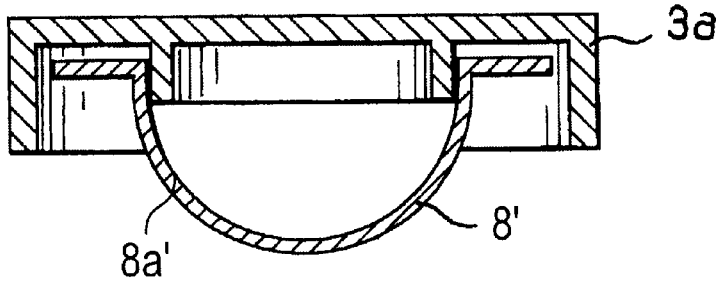
FIG. 9 is a cross section view of an alternative embodiment of a lid.

FIG. 9 shows an alternate embodiment of the lid, in which the inner surface 8*a'* of the lid 3*a* forms part of a dome that is fitted in the remainder of the lid 3*a*, with the dome 8' possibly being made out of a material that is more flexible than the lid. This may make it possible, where appropriate, to omit sealing means between the case body and the lid.

Figure 10:
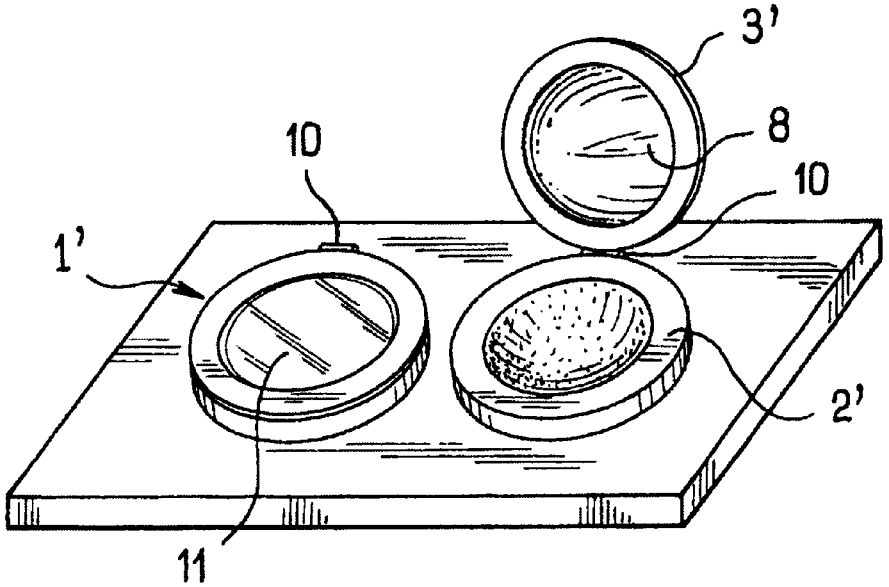
FIG. 10 shows an exemplary embodiment of a device implementing two packaging cases.
Figure 10A:
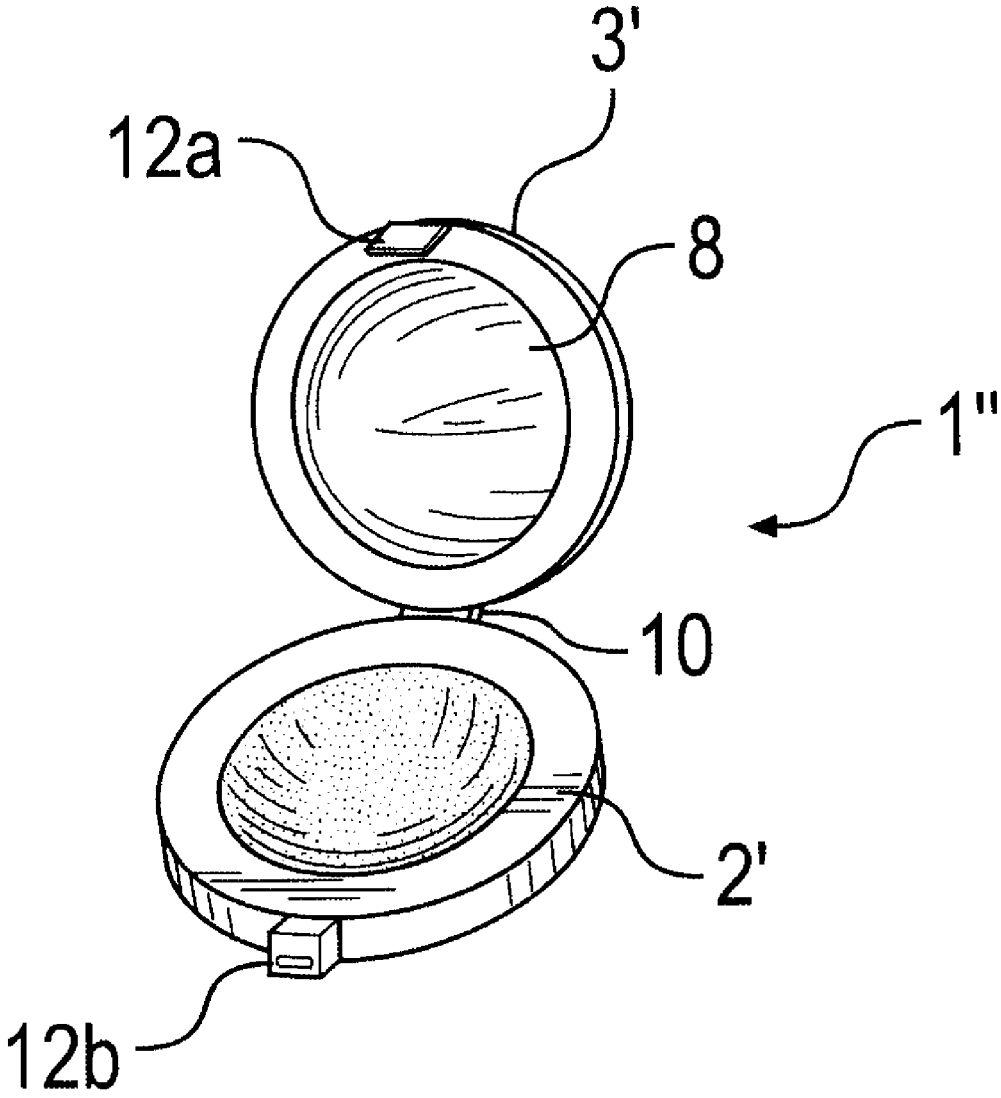
FIG. 10A shows another exemplary embodiment of a device having a snap fastener for opening and/or closing the case body.

FIG. 10 shows a makeup device implementing two cases 1', one of which is shown in the open position and the other of which is shown in the closed position. The cases differ from those described above because the case body 2' and the lid 3' are not fastened together by screw fastening, but instead are connected together by means of a hinge 10. In an exemplary embodiment, conventional snap-fastening means 12*a* and 12*b*, as shown in FIG. 10A, may also be provided to lock the lid onto the case body. In addition, a mirror 11 may also be installed on the outside face of the lid.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A case for packaging a substance, comprising:

a case body defining a cavity for receiving the substance; and a lid configured to enclose the substance between the lid and the case body in a leak-proof manner, wherein the lid and the case body have internal profiles configured so that, at least prior to a first use of the substance, and after the substance has flowed under the effect of its own weight while the lid is not present on the case body, installing the lid on the case body presses the lid against the substance to reduce a maximum thickness of the substance, and wherein an inner surface of the lid in contact with the substance when the lid is installed on the case body is dome-shaped.

2. The case of claim 1, wherein an inside of the lid defines a surface having substantially the same shape as the cavity in the case body, the surface of the lid being configured so that when the lid is in place on the case body, the lid surface and the case body define a gap having a height smaller than a depth of the cavity, such that when the case is in a closed position, the substance substantially fills the gap and comes into contact with the lid surface and a portion of the case body defining the cavity.

3. The case of claim 1, wherein the cavity and the inner surface of the lid have a substantially hemispherical shape.

4. The case of claim 3, wherein, the inner surface of the lid has a diameter less than a diameter of the cavity.

5. The case of claim 1, wherein a portion of the lid having the internal profile is formed integral to the remainder of the lid.

6. The case of claim 1, wherein a portion of the lid having the internal profile is at least partially dome-shaped and is a separate element fitted to the remainder of the lid.

7. The case of claim 1, wherein at least one of the case body and the lid is made at least in part out of transparent material.

8. The case of claim 1, wherein at least one of the case body and the lid is made at least in part out of translucent material.

9. The case of claim 1, wherein the lid and the case body are configured to be assembled together by screw fastening.

10. The case of claim 1, wherein the lid has screw threading to be engaged with corresponding screw threading on the case body.

11. The case of claim 1, further comprising a hinge pivotally connecting the lid to the case body.

12. The case of claim 1, further comprising a snap fastener for fastening the lid in a closed position.

13. The case of claim 1, wherein a portion of the lid having the internal profile has at least one of at least one surface property and at least one surface configuration differing from that of a portion of the case body defining the cavity so as to retain the substance on the lid.

14. The case of claim 1, wherein a portion of the case body defining the cavity has at least one of at least one surface property and at least one surface configuration differing from that of a portion of the lid having the internal profile so as to retain the product in the case body.

15. The case of claim 1, wherein the lid further comprises a seal element for enclosing the substance between the lid and the case body in a leak-proof manner.

16. The case of claim 1, wherein at least one of the internal profile of the lid and the internal profile of the case body has a shape that is not a body of revolution.

17. The case of claim 1, further comprising a semiliquid product contained in the case.

18. The case of claim 1, further comprising a viscoelastic product contained in the case.

19. The case of claim 1, further comprising a product contained in the case, wherein the product comprises at least one associative polymer.

20. The case of claim 1, further comprising a product contained in the case, wherein the product comprises at least one of a makeup product and a care product.

21. A method for packaging a substance, comprising:

providing the case of claim 1;

flowing into the cavity at least a predetermined amount of a substance; and placing the lid on the case body, thereby pressing the lid against the substance to cause the substance to fill substantially a gap defined between the lid and the case body.

22. The method of claim 21, wherein the substance is a semiliquid product.

23. The method of claim 21, wherein the substance is a viscoelastic product.

24. The method of claim 21, wherein the substance comprises at least one of a makeup product and a care product.

25. The case of claim 1, wherein the lid is configured to change the shape of the upper surface of the substance when the lid is placed on the case body in a closed position.

26. The case of claim 1, wherein at least a portion of the inner surface of the lid in contact with the substance when the lid is installed on the case body is defined by rigid material.

27. A case for packaging a substance, comprising:

a case body comprising an inner surface defining a cavity for receiving the substance; and a lid comprising a dome-shaped inner surface configured to press against the substance in the case body to enclose the substance in a leak-proof manner, wherein the inner surface of the case body and the inner surface of the lid have substantially the same shape and are arranged so that when the lid is put into place on the case body, the inner surfaces define a gap having a non-uniform thickness and a height smaller than a depth of the cavity, such that when the case is in a closed position, the substance substantially fills the gap and comes into contact with the inner surfaces.

28. A method for packaging a substance, comprising:

providing the case of claim 27;

flowing into the cavity at least a predetermined amount of a substance; and placing the lid on the case body, thereby pressing the lid against the substance to cause the substance to substantially fill a gap defined between the lid and the case body.

29. A method for packaging a substance, comprising:

providing a container comprising a lid and a cavity, at least a portion of the lid having a dome-shaped inner surface configured to protrude at least partially into the cavity;

flowing into the cavity at least a predetermined amount of the substance; and placing the lid in a closed position on the cavity to thereby put the lid in contact with the substance and cause the substance to substantially fill a gap having a non-uniform thickness defined between the inner surface of the lid and a portion of the container defining the cavity.

* * * * *